United States Patent [19]

Desenfant

[11] 4,050,538

[45] Sept. 27, 1977

[54] NOISE REDUCING SCREEN

[75] Inventor: André L. Desenfant, Bures sur Yvette, France

[73] Assignee: Societe d'Etudes Generales de Communications Industrielles et Civiles-Segic, Rungis, France

[21] Appl. No.: 583,911

[22] Filed: June 5, 1975

[51] Int. Cl.[2] ..... E04H 17/00; E04B 1/82

[52] U.S. Cl. ..... 181/210

[58] Field of Search ..... 181/33 G, 33 E, 33 HE, 181/141; 256/13.1

[56] References Cited

U.S. PATENT DOCUMENTS

| | | | |
|---|---|---|---|
| 3,630,310 | 12/1971 | Federer | 181/33 G |
| 3,656,576 | 4/1972 | Gubela | 181/33 G |
| 3,783,968 | 1/1974 | Derry | 181/33 G |
| 3,812,931 | 5/1974 | Hauskins | 181/33 E |
| 4,015,682 | 4/1977 | Keller | 181/33 E |

FOREIGN PATENT DOCUMENTS

| | | | |
|---|---|---|---|
| 7,400,436 | 7/1974 | Netherlands | 181/33 E |

OTHER PUBLICATIONS

Michael Rettinger, *Acoustic Design and Noise Control,* Chemical Publishing Co. Inc., New York, 1973, pp. 332–339.

Cyril M. Harris, *Handbook of Noise Control,* McGraw--Hill Book Co. Inc., New York, 1957, pp. (2-4) - (2-6).

Ulrich J. Kurze, "Noise Reduction by Barriers", Journal of the Acoustical Society of America, vol. 55, No. 3, Mar. 1974, pp. 504–506.

Michael Rettinger, "Noise Level Reduction of 'Depressed' Freeways", Noise Control, July 1959, pp. 12–14,& 54.

*Primary Examiner*—Lawrence R. Franklin

[57] ABSTRACT

Noise reducing screen disposed between an elongated noise source formed by a motorway or a railway and a building located along one side of this noise source and to be shielded therefrom. This noise reducing screen comprises a continuous wall portion having a whole length $2d$, built up between the elongated noise source and the building on both sides of a perpendicular drawn from the building point the most remote from the noise source and located at a distance $D$ therefrom to the elongated noise source and a plurality of variably spaced apart posts aligned with said wall portion, these posts having a length $a$ and a width $b$ repectively parallel and perpendicular to the elongated source, the spacing between the $n^{th}$ and $(n-1)^{th}$ post being at most equal to $$dp^n + (a-d)p^{n-1} \text{ with } n \geq 2 \text{ (and } dp \text{ for } n=1)$$

where $p$ is the ratio $D/(D-b)$

It results from this spacing that all rectilinear noise propagation paths from the noise source to the building are intercepted by the posts.

4 Claims, 15 Drawing Figures

NOISE REDUCING SCREEN

BACKGROUND OF THE INVENTION

1. Field of the Invention

The invention relates to a screen for reducing noise in buildings alongside a road where the traffic is sufficient to require such protection. This noise reducing screen comprises at least a continuous portion in the form of tunnel which is interposed between an elongated noise source such as a motor-road and a building on both sides of a perpendicular drawn from the building point the most remote from the elongated noise source and located at a predetermined distance therefrom to the elongated noise source.

2. Description of the Prior Art

It is known that the nuisance resulting from traffic noise, particularly on main roads or railways, is a serious problem, particularly in build-up areas. The noise is due partly to motor vehicles, more particularly with internal combustion motors, and partly to the noise of wheels on roads or railways.

The noise in a roadside building may be reduced by disposing continuous walls between the building and the source of noise, which is distributed all the way along the road, the walls reducing the amount of transmitted sound energy in a manner which is substantially dependent on the surface density (mass per unit surface) of the walls. In general, the continuous walls can be regarded as an "umbrella" over the building to be protected, just as if the noise source was an elongated light source.

FIGS. 1 to 3 show three examples of roads provided with conventional continuous screens for reducing noise in adjacent buildings.

In the relatively simple case of a low building on one side only of the road, the screening can be reduced to a single continuous side wall (FIG. 1). The ends of the wall are those points whose distance to the building involves such a noise attenuation that the attenuated noise can be tolerated. If the building to be protected is relatively high, the side screens cannot be made sufficiently high; in such cases, they may be supplemented by a continuous cover over part (FIG. 2) or all of a traffic artery. This cover can be overhanging or supported by posts. Finally, if relatively high buildings have to be shielded on both sides of the road, the road has to be enclosed in a true tunnel (FIG. 3).

In the two examples with cover, we have assumed that the ground does not have any relief. If the road is in a cutting and has to be covered, the cover can bear on the top of the lateral embankments and/or on the retaining walls.

Sound measurements teach that the sound energy received from a portion of a traffic artery by an observer located near this traffic artery and at a certain height above ground level varies substantially in proportion to the plane angle under which the observer is seeing the artery portion. In practice, it is desired to produce a reduction in sound energy of the order of 10 to 20 decibels (corresponding to sound ratios of the order of 10 to 100).

In very many cases, therefore, it appears desirable to screen from the observer's view nearly all the traffic artery, which is thereby converted into a true, but very long, tunnel. This results in a first difficulty in that such work is extremely expensive. In addition, it is known that existing long road tunnels pose serious ventilation problems if the internal atmospheric pollution due to exhaust gases, inter alia carbon monoxide and fumes, is to be limited to a level compatible with the health or even the survival of persons and with the safety of the traffic (e.g. by not obscuring air). Ventilation can be provided only by heavy, expensive ventilation apparatus, the investment and maintenance costs of which increase in proportion to the amount of traffic.

The object of the invention is to provide a noise-reducing system of the kind previously defined, which is at least largely free from the aforementioned disadvantages.

To this end, a noise-reducing system of the aforementioned kind according to the invention is characterized in that, in addition to a continuous screening wall, wall and cover or tunnel structure, it comprises an at least partly discontinuous screening structure, the discontinuous part being made up of sectional elements, hereinafter called sound-proofing elements, having the shape of posts, posts with an upper overhanging bracket or double posts with a cross-beam, which are disposed substantially at right angles to the road and which are staggered, allowing for their dimensions in the cross-sectional plane of the post, bracket or beam, at intervals such that an observer is screened from the road traffic at any point in the building to be protected.

The various shapes of the sound-proofing elements, simple post, jib or gantry, depend on the relief of the ground and/or the local environmental conditions at the building to be protected. The sound-proofing elements may have the form of simple beams bearing (on one or both sides) on the tops of embankments lining a cutting. They can be provided with an intermediate wall or retaining posts.

Each of the sound-proofing elements may be either:

solid, at least in certain parts thereof, in which case it has a preferably I-shaped cross-section for the horizontal parts and a rectangular cross-section for the vertical parts, the solid parts being made from a material such as reinforced or prestressed concrete, steel, a light metal or alloy, a plastic preferably reinforced with glass or nylon, or wood, preferably glued plywood; or hollow, at least in certain parts thereof, in which case the cross-section is preferably rectangular, the hollow parts being made from a material such as steel sheet, sheets of a light metal or alloy, or glass or nylon reinforced plastics.

As a rule, owing to the fact that the sound-proofing elements are disposed at relatively large distances from the buildings to be protected and the sound energy transmitted per unit surface of the source decreases substantially in inverse proportion to the square of the distance, the requirements regarding the surface density of the sound-proofing elements can be considerably less exacting than for the surface density of continuous walls which are near the region to be protected.

Finally, according to partly known features each of the sound-proofing elements may also comprise either:

a plate or layer of absorbent material along at least one vertical side of the solid parts, such material being e.g. straw-cement, mineral wool, open-cell foam plastics or reconstituted wood felt, the layer being protected if required by a flexible plastics diaphragm; or a perforated sheet along at least one vertical side of the hollow parts, the resulting cavity containing at least one panel of absorbent material such as straw-cement, mineral wool, open-cell plastics foam or reconstituted wood felt, the panel being protected if required, by enveloping it in a welded plastics bag.

The last-mentioned feature absorbs the fraction of sound energy which is transmitted to the region to be protected, as a result of reflection or diffusion between successive adjacent sound-proofing elements. If only one surface of each sound-proofing element is provided with absorbent material, that surface is selected which is visible to the observer to be protected. The absorbent element can be protected by a flexible plastics diaphragm or bag so as to shelter it from rain, fumes and corrosive agents of all kinds.

BRIEF DESCRIPTION OF THE DRAWING

The invention will be more clearly understood from the following description of some embodiments and from the corresponding accompanying drawings, wherein.

Figures 1, 2, 3:
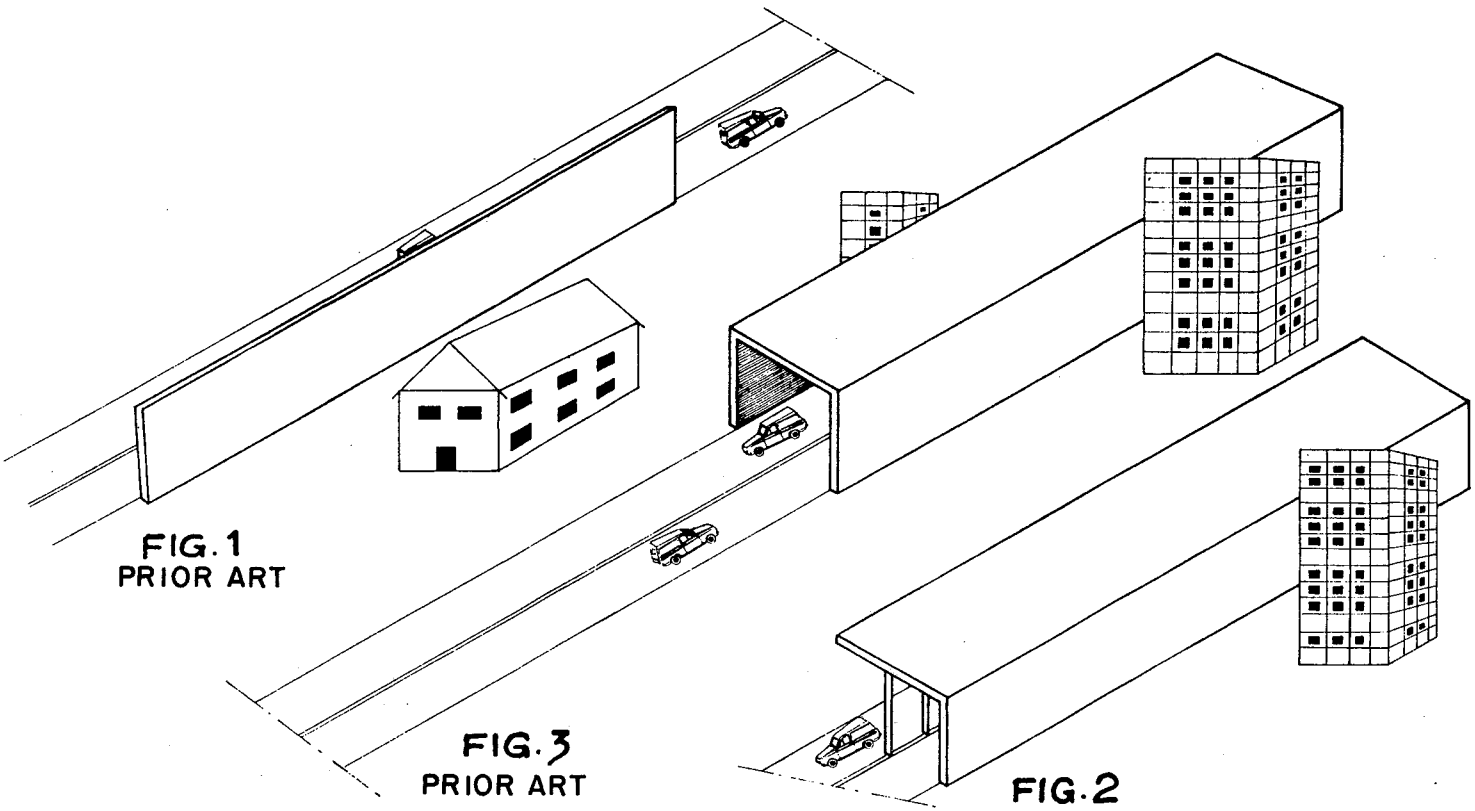
FIG. 1 PRIOR ART
FIG. 2 PRIOR ART
FIG. 3 PRIOR ART
FIGS. 1, 2 and 3 are diagrammatic perspective views of roads provided with conventional continuous screens for reducing noise in adjacent buildings; they have been disclosed in the introducing part.
Figure 4:
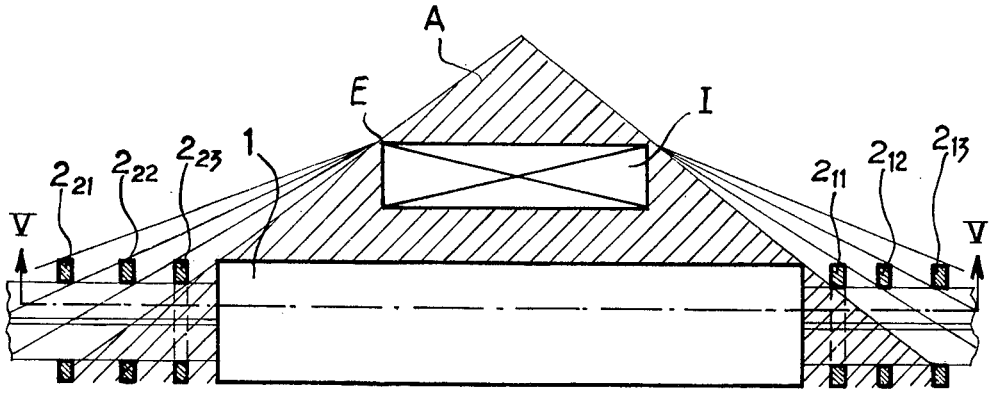
FIGS. 4 and 5 are diagrams, FIG. 4 being in horizontal cross-section along line IV—IV of FIG. 5 and FIG. 5 being in vertical cross-section along line V—V of FIG. 4, of an example of noise reduction in a building alongside a road, using a combined system consisting partly of a tunnel and partly of sound-proofing elements according to the invention.
Figure 5:
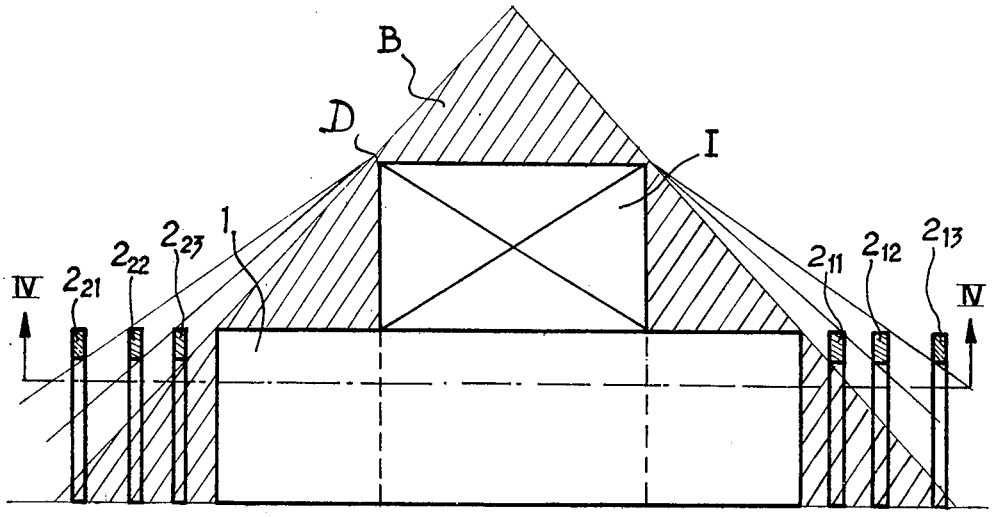

The example of a noise-reducing system shown in FIGS. 4 and 5 comprises a continuous road tunnel 1 opposite a building I, the length of the tunnel being greater than the frontages of the building. The length of the tunnel is determined by the distance of the ends thereof to the building which must involve the desired attenuation. The tunnel length, according to the invention, can be substantially shortened by positioning sound-proofing elements $2_{11}$, $2_{12}$, $2_{13}$, . . . , $2_{21}$, $2_{22}$, $2_{23}$, . . . forming a continuation of the tunnel on each side thereof. In the chosen example, the sound-proofing elements have the general form of a gantry, each one comprising a horizontal beam and two supporting posts, the beam and the posts having substantially rectangular cross-sections.

The shaded triangular areas A, B on FIGS. 4, 5 respectively denote "acoustic shadow" regions defined by the ends of the tunnel and of the building to be protected. The sound-proofing elements are adapted to extend the shadow region to the non-tunnelled portions of the road extending from the two ends of the tunnel, with respect to an observer situated in the most unfavourable position in the building (on the vertical rear gable edge E in the case of FIG. 4 or on the top horizontal gable edge D in the case in FIG. 5). To this end, shown in FIGS. 4 and 5, it is merely necessary that the oblique lines extending from the aforementioned unfavourable positions and bearing on the outer edges of the beams (FIG. 5) and of the posts (FIG. 4) of the sound proofing elements, should at least slightly intersect the inner surfaces of the adjacent beams and posts.

Clearly, the aforementioned extensions of the acoustic shadow region depend both on the dimensions of the beams and posts in directions perpendicular to the road, and on the spacing between them. If the beams and posts have constant cross-sections, the spacing between the sound-proofing elements continuously increases as the distance from the building to be protected increases.

Figure 11:
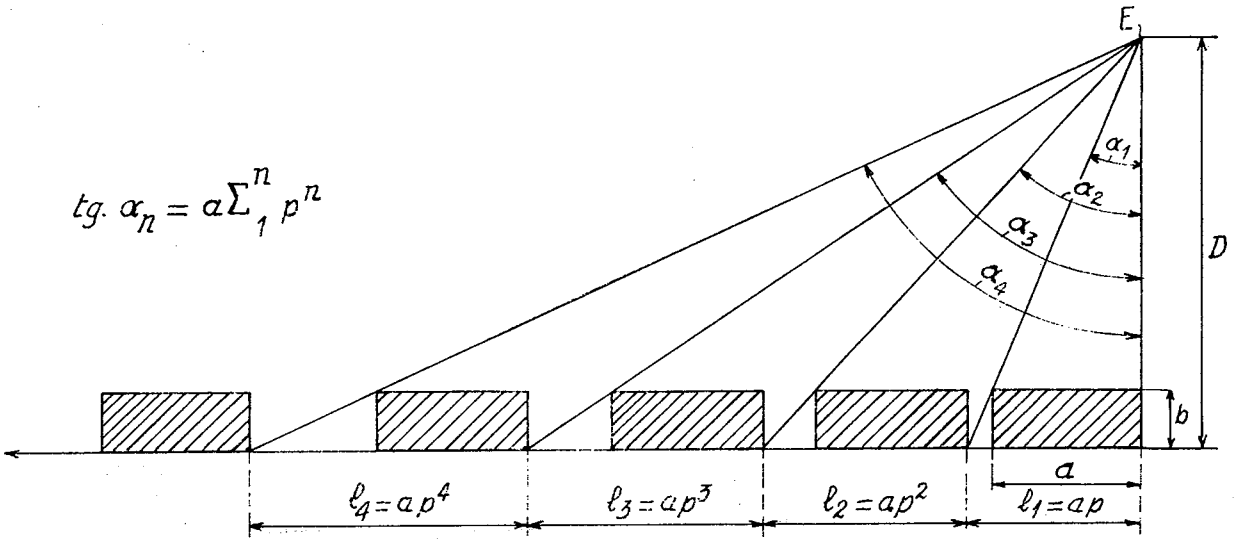
FIG. 11 is a geometric diagram allowing calculation of the distances between sound-proofing elements.

Referring now to FIG. 11, let $a$ and $b$ be the dimensions of the sides of the cross-sectional rectangle of a post, respectively parallel and perpendicularly to the road, D the distance of point E to the line of the variably spaced apart posts which are on the same side of the road that the building and $p$ the ratio $D/(D\text{-}b)$. The distance between two adjacent posts is determined by the condition that converging straight lines passing through point E also pass through the outer left corner of a post rectangular cross-section and the inner right corner of the rectangular cross-section of the following post according to the example of FIG. 11 when the following posts are on the left hand side of point E. The distance $1_n$ between the middle planes of the $(n\text{-}1)^{th}$ and $n^{th}$ posts is $$1_n = ap^n$$

The whole length of an "apertured" tunnel including $n$ posts is $$\sum_1^n l_n = 2ap\frac{p^n - 1}{p - 1}$$

This length is proportional to $a$ and, for large values of $n$, to $p^n$. Thus the length of the "apertured" tunnel is more sensitive to parameter $b$ than to parameter $a$.

An example of "apertured" tunnel is given hereunder $$a = 0.3\text{ m } b = 0.5\text{ m } D = 30\text{ m } p = 30/29.5 = 1.0169$$

In a first case, the "apertured" tunnel has solely a discontinuous portion. Let us assume that the ends of this tunnel are defined when the interval between gantries is equal to the gantry thickness i.e.

$$a(p^n - 1) = a$$
$$n = \log 2/\log p = 41.36$$

Therefore the tunnel comprises $(2n-1)$ or 83 posts or gantries, the first two gantries $(n=1)$ forming a gantry of length equal to $2a$.

In a second case, the "apertured" tunnel comprises a continuous portion of length 2 $d$ and a discontinuous portion on each side of this continuous portion. The length 2 $d$ may be given from experimental results in dependance of traffic noise and location of a building on a side all the way along the road, or from theoretical results.

By way of non-limiting example, let us assume that a low building is located between a high building and the road, and that it is necessary to insert a continuous portion of length substantially equal to the length of a discontinuous portion calculated as if the high building is not present. So, this computation indicates that this discontinuous portion comprises $(2\ N-1)$ gantries is efficient without the high building when the interval between gantries would be equal to four times the thickness of a gantry:

$$a(p^N - 1) = 4a$$

$$N = \log 5/\log p = 96.03$$

Thus, the whole length of the continuous portion of the tunnel with the presence of the high building is:

$$2d = 2 \times \sum_{1}^{96} l_N = 2 \times 0.3 \times 1.0169 \frac{1.0169^{96} - 1}{0.0169} = 144.3 \text{ m.}$$

The spacing of the successive gantries of the real discontinuous portion of the "apertured" tunnel are: $L_n = ap^{N+n}$ with $N = 96$, i.e.,

| | |
|---|---|
| $L_1 = 1.524$ m | $L_{10} = 1.772$ m |
| $L_2 = 1.550$ m | $L_{11} = 1.802$ m |
| $L_3 = 1.576$ m | $L_{12} = 1.833$ m |
| $L_4 = 1.603$ m | $L_{13} = 1.864$ m |
| $L_5 = 1.630$ m | $L_{14} = 1.895$ m |
| $L_6 = 1.657$ m | $L_{15} = 1.927$ m |
| $L_7 = 1.685$ m | $L_{16} = 1.960$ m |
| $L_8 = 1.714$ m | $L_{17} = 1.993$ m |
| $L_9 = 1.743$ m | $L_{18} = 2.026$ m |

The whole length of the discontinuous portion of the apertured tunnel is:

$$2 \sum_{1}^{18} L_n = \frac{2 \times 0.3 \times 1.0169}{0.0169} (1.0169^{114} - 1.0169^{96}) = 63.50 \text{ m}$$

which comprises a solid part having a totalized length of $$2 \times (18) \times 0.3 = 10.80 \text{ m}$$

and an "apertured" part having a totalized length of $63.50 - 10.80 = 52.70$ m In this example it is assumed that the discontinuous portion with at least (2 × 18) gantries produces a reduction in sound energy higher than 10 decibels. In the above mentioned example, the length of the continuous portion has been computed. In the case where this length 2 $d$ is given from experimental results, the spacing between the $n^{th}$ and the $(n-1)^{th}$ gantries of the discontinuous portion of the "apertured" tunnel is calculated in function of the length 2 $d$ in an analogous manner for each side of the continuous portion:

$$L_n = dp^n + (a - d)pn^{-1} \text{ with } n \geqq 2 \text{ and } L_1 = dp$$

If $d = a$:

$$L_n = l_n$$

Of course, the extent to which it may be necessary (a) to combine continuous protection and sound-proofing elements and (b) to extend the sound-proofing elements in the form of simple horizontal beams or vertical posts or in the form of jibs or gantries may vary in particular cases, inter alia in dependence on the surrounding relief and in dependence on the height and position of the buildings to be protected.

Figure 6:
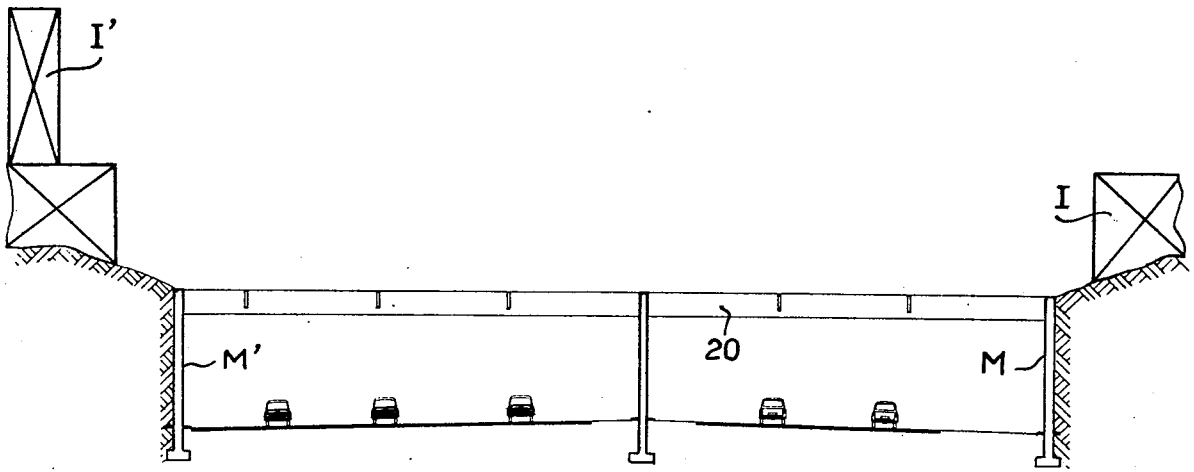
FIGS. 6 and 7 are views in section, perpendicular to a motorway, of a region provided with sound-proofing elements according to the invention.
Figure 7:
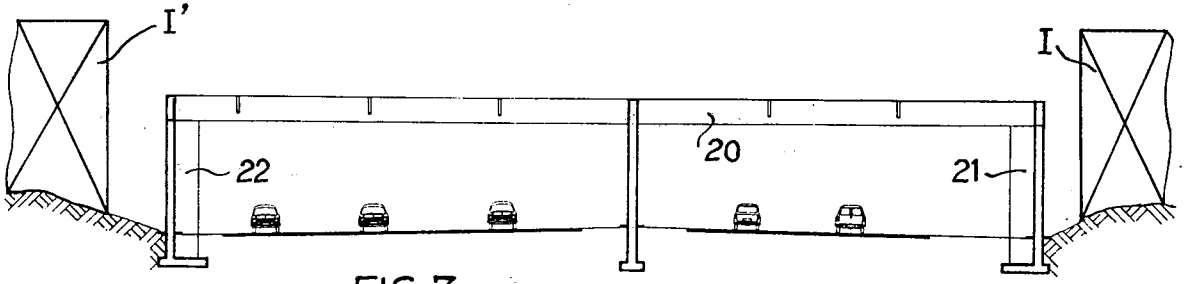
Figure 8:
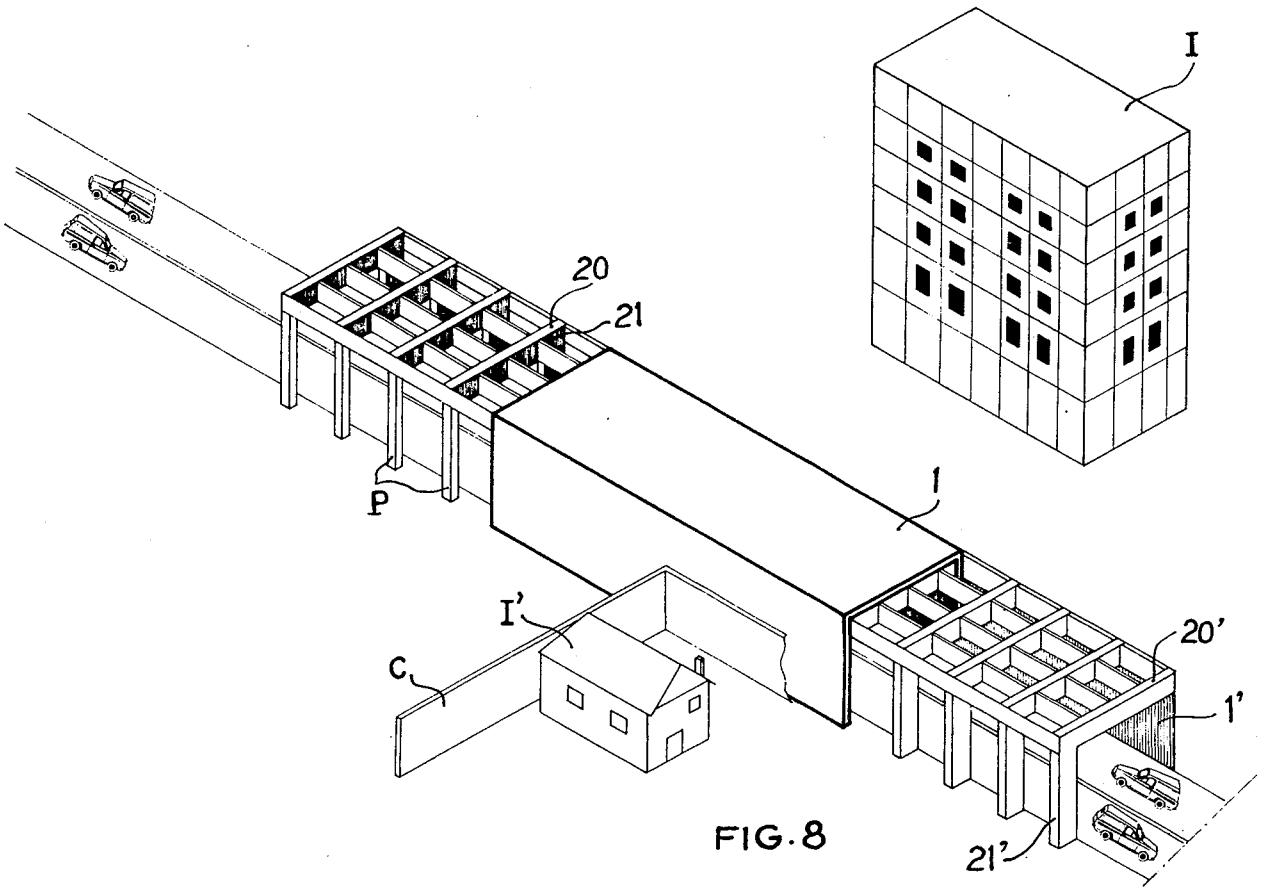
FIG. 8 is a perspective view of a system for reducing noise in buildings alongside a motorway, the system comprising sound-proofing elements according to the invention.

For example:

in FIG. 6, representing a cross-section of a motorway in cutting, it may be adequate, at a sufficient distance from the buildings I, I' to be protected, to reduce the sound-prrofing elements to simple horizontal beams 20 bearing on retaining walls M, M';

in FIG. 7, on the contrary, which represents a motorway where the ground has slight relief, the sound-proofing elements should normally be designed in the form of gantries including posts 21 and 22 and beams 20; and in FIG. 8, continuous protection in the form of a single vertical wall 1' is required alongside a high building I on one side of tunnel 1, and discontinuous protection in the form of vertical sound-proofing elements prolonged in the form of jibs 20, 21 is required on the other side of the tunnel; in the case of a low building I', discontinuous protection in the form of vertical sound-proofing elements prolonged in the form of jibs 20', 21' is required on the other side of the tunnel and practically no protection is required on the other side of the tunnel, since the low building is protected by its own fences C, the aforementioned jibs 20, 21 bearing on single retaining posts P.

Finally, in the case where the buildings to be protected are on only one side of the road, the horizontal beams of the sound-proofing elements may have a reduced length corresponding to only a fraction of the total width of the road.

Figure 9A:
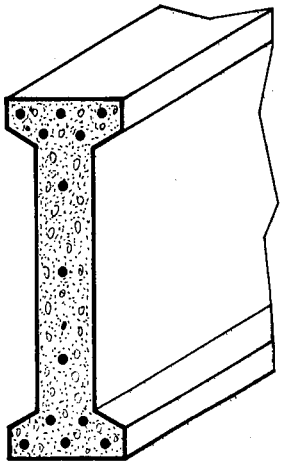
FIGS. 9A, 9B, 9C are diagrammatic perspective views of sound-proofing elements made respectively of concrete, glued plywood, and sheet steel.
Figure 9B:
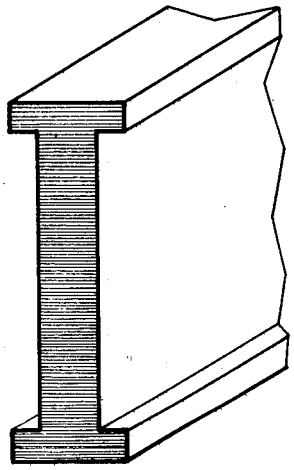
Figure 9C:
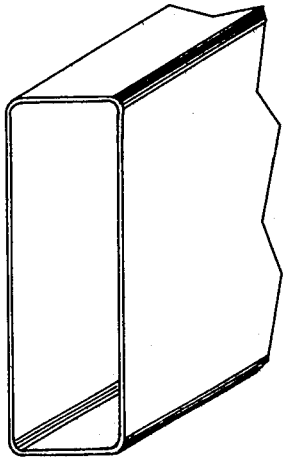

The sound-proofing elements can have a solid cross-section, at least in certain parts thereof, in which case their cross-section is either an I in order to offer a low resistance to the wind pressure (FIGS. 9A, 9B) or is rectangular; alternatively, they can have hollow cross-sections at least in certains parts thereof, in which case the cross-section is preferably rectangular (FIG. 9C).

Figure 10A:
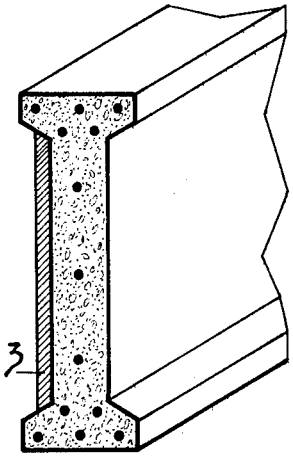
FIGS. 10A, 10B and 10C are diagrammatic perspective views of the same sound-proofing elements, except that they are provided with sound-absorbing elements.
Figure 10B:
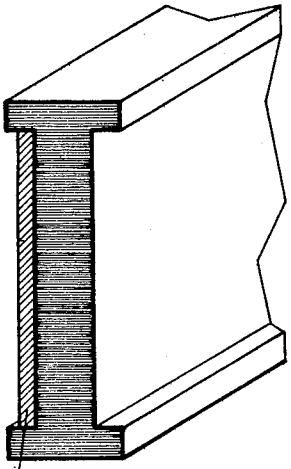
Figure 10C:
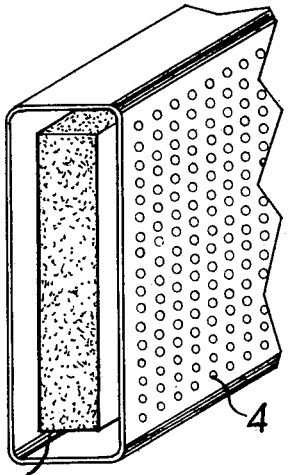

The same sound-proofing elements can be provided with absorbent elements 3, which are either applied to at least one of the vertical surfaces of the core of each sectional member (FIGS. 10A, 10B) or are disposed inside a cavity formed by a caisson (FIG. 10C), in which case at least one of the major vertical surfaces 4 of the caisson is perforated.

As aforementioned, the sound-proofing elements and the absorbent elements may be made of materials which are selected in each case in dependence on a number of parameters including the load, the span, the resistance to bad weather and pollution, the cost, and other factors.

What I claim is:

1. A noise reducing screen disposed between an elongated noise source and a building having a continuous wall portion to be shielded from the noice source and located along one side of the elongated noise source;

said noise reducing screen comprising:

a continuous wall portion having a whole length $2d$ which is built up between said elongated noise source and said building on both sides of a perpendicular drawn from the building point which is the most remote from the noise source and is located at a distance $D$ therefrom to said elongated noise source;

a plurality of variably spaced apart posts aligned with said wall portion;

said posts having a length $a$ and a width $b$ respectively parallel and perpendicular to said elongated source;

the spacing between the $n^{th}$ and $(n-1)^{th}$ post being at most equal to $dp^n + (a-d)p^{n-1}$ with $n \leqq 2$ (and $n = 1$:$dp$) where $p$ is the ratio $D/(D-b)$;

whereby all rectilinear noise propagation paths from said noise source to said building are intercepted by said posts; and noise absorbent means on said posts.

2. A noise reducing screen as set forth in claim 1, in which the absorbent means for said posts constitutes layers of noise absorbent material along at least one vertical side thereof perpendicular to said elongated noise source.

3. A noise reducing screen disposed between and elongated noise source and a building having a continuous wall portion to be shielded from the noise source and located along one side of the elongated noise source;

said noise reducing screen comprising:

a continuous tunnel portion having a whole length $2d$ enclosing a portion of said elongated noise source;

said tunnel portion built up on both sides of a perpendicular drawn from the building which is the most remote from the noise source and is located at a distance $D$ therefrom to said elongated noise source;

a plurality of variably spaced apart gantries each comprising two posts and a beam aligned with said tunnel portion and perpendicular to said elongated noise source;

the posts and the beams of said gantries having a length $a$ and and width $b$ respectively parallel and perpendicular to said elongated noise source;

the spacing between the $n^{th}$ and $(n-1)^{th}$ gantries being at most equal to $dp^n + (a-d)p^{n-1}$ with $n \leqq 2$ (and $n=1:dp$) where $p$ is the ratio $D/(D-b)$;

whereby all rectilinear noise propagation path from said noise source to said building are intercepted by the posts and the beams of said gantries; and noise absorbent means on said gantries.

4. A noise reducing screen as set forth in claim 3, in which said noise absorbent material for the posts and the beams of the gantries is formed of layers of noise absorbent material along at least their faces perpendicular to said elongated noise source.

* * * * *